US008914920B2

(12) United States Patent
Niklasson

(10) Patent No.: US 8,914,920 B2
(45) Date of Patent: Dec. 23, 2014

(54) PATIENT LIFT AND COUPLING THEREFOR

(75) Inventor: Therese Niklasson, Malmo (SE)

(73) Assignee: ARJO Hospital Equipment AB (SE)

( * ) Notice: Subject to any disclaimer, the term of this patent is extended or adjusted under 35 U.S.C. 154(b) by 0 days.

(21) Appl. No.: 13/497,756

(22) PCT Filed: Sep. 21, 2010

(86) PCT No.: PCT/EP2010/063856

§ 371 (c)(1),
(2), (4) Date: Jun. 4, 2012

(87) PCT Pub. No.: WO2011/036140

PCT Pub. Date: Mar. 31, 2011

(65) Prior Publication Data

US 2012/0240333 A1 Sep. 27, 2012

(30) Foreign Application Priority Data

Sep. 24, 2009 (EP) ..... 09171280
Jun. 11, 2010 (EP) ..... 10165718

(51) Int. Cl.
*A61G 7/10* (2006.01)

(52) U.S. Cl.
CPC ..... *A61G 7/1017* (2013.01); *A61G 7/1061* (2013.01); *A61G 2200/34* (2013.01)
USPC ..... 5/83.1; 5/89.1; 5/87.1

(58) Field of Classification Search
USPC ..... 5/87.1, 89.1, 83.1, 81.1, 84.1, 85.1, 5/86.1
See application file for complete search history.

(56) References Cited

U.S. PATENT DOCUMENTS

| | | | | | |
|---|---|---|---|---|---|
| 428,602 | A * | 5/1890 | A.Harley | 5/84.1 |
| 1,033,277 | A * | 7/1912 | Seashole | 5/86.1 |
| 1,269,734 | A * | 6/1918 | Noland | 5/84.1 |
| 3,608,104 | A | 9/1971 | Van Geryen | |
| 3,996,632 | A * | 12/1976 | Bakker nee Viel | 5/83.1 |
| 5,649,329 | A * | 7/1997 | Horcher et al. | 5/83.1 |
| 6,219,862 | B1 * | 4/2001 | Horcher et al. | 5/89.1 |
| 6,637,610 | B1 * | 10/2003 | Cheeseboro | 212/327 |
| 7,237,491 | B2 * | 7/2007 | Faucher et al. | 104/89 |

(Continued)

FOREIGN PATENT DOCUMENTS

| | | |
|---|---|---|
| DE | 85 27 201 U1 | 1/1986 |
| EP | 1 676 553 A2 | 7/2006 |
| GB | 2 184 706 A | 7/1987 |
| GB | 2 272 679 A | 5/1994 |

OTHER PUBLICATIONS

International Search Report for PCT/EP2010/063856, mailed Jan. 17, 2011.

*Primary Examiner* — Robert G Santos
*Assistant Examiner* — Ifeolu Adeboyejo
(74) *Attorney, Agent, or Firm* — Brinks Gilson & Lione

(57) ABSTRACT

A patient lift including a boom a spreader bar, and a friction coupling for securing the boom and the spreader bar. The friction coupling may include two friction washers disposed against respective inner faces of the boom. Two compression springs are disposed abutting the friction washers with a spreader bar support member in between. The compression springs urge the friction washers against the inner faces of the boom end. The spreader bar does not swing when the lift is moved without load. Also, the friction coupling reduces the swing of the patient, when transferred in the lift. This makes the lift easier to maneuver for the caregiver.

7 Claims, 11 Drawing Sheets

(56) References Cited

U.S. PATENT DOCUMENTS 7,284,745 B2 * 10/2007 Keane et al. ..... 254/372
8,474,073 B2 * 7/2013 Hamberg et al. ..... 5/600
2003/0070227 A1 * 4/2003 Schroeter ..... 5/86.1
2009/0165203 A1 * 7/2009 Biersteker et al. ..... 5/83.1
2010/0005585 A1 * 1/2010 Spidare et al. ..... 5/83.1

* cited by examiner

PATIENT LIFT AND COUPLING THEREFOR

CROSS-REFERENCE TO RELATED APPLICATIONS

This application is a non-provisional application which claims priority to European Patent Application Nos. EP09171280.2 filed Sep. 24, 2009; EP10165718.7 filed Jun. 11, 2010; and PCT Application No. PCT/EP2010/063856 filed Sep. 21, 2010, each of which is incorporated by reference herein in its entirety.

TECHNICAL FIELD

The present invention relates to a lift device, a coupling therefor and more particularly, to a structure for attaching a spreader bar to patient lifts.

BACKGROUND

Patient lifts are generally known in the health care industry. Such patient lifts help a caregiver to transfer a patient from one place to another such as bed to chair, toilet, stretcher, and so on.

There are primarily two types of such patient lifts, arc lifts and column lifts. Examples of these are shown in FIGS. 1 and 2 respectively. These lifts typically include a support arm or boom and a spreader bar or cradle supported by the boom. A sling for lifting a patient is hung from the spreader bar or cradle.

The difference between an arc lift and a column lift is mostly in the movement of the boom. The boom of an arc lift is fixed at one point to a mast. The movement of the boom is an arc around this fixed point. The boom of a column lift glides vertically along a mast. Both type of lifts are compatible with different types of spreader bars that answer different needs.

The problem with arc lifts is that, in order for the spreader bar to stay parallel to the floor during the full lifting stroke, the connection point needs to allow a swinging movement. This problem is not seen with column lifters because the spreader bar is maintained parallel to the floor by the boom which moves along the mast vertically and not in an arc motion.

Although this swinging movement is necessary, it can be dangerous. As can be seen in FIG. 3, swinging of the arc boom will tend to cause the spreader bar to swing outwardly and towards the patient. Therefore, when the care worker approaches the patient, he or she needs to be very careful not to hit the patient with the spreader bar.

BRIEF SUMMARY

The present invention seeks to provide an improved patient lift and coupling for such lifts.

According to an aspect of the present invention, there is provided a patient lift composing a boom, a spreader bar characterised in that a friction coupling releasably attaches the boom and spreader bar. The friction coupling restricts the movement of the spreader bar and eliminates the risk of the spreader bar swinging against the patient's face. Furthermore, the friction reduces the swing of the patient when transferred in the lift. This makes the lift easier to manoeuvre for the caregiver.

Preferably, the friction coupling includes one or more friction plates fixed onto inside of the boom end, the spreader bar being located in between the friction plate or plates. Advantageously, one or more springs bias the friction plates outwards towards the inside of the boom end.

In another embodiment, the friction coupling includes a contact surface rotatable with said coupling and a friction element which contacts said contacting surface at a circumferential surface thereof.

In another embodiment, the friction coupling includes a damper element.

BRIEF DESCRIPTION OF THE DRAWINGS

Embodiments of the present invention are described below, by way of example only, with reference to the accompanying drawings, in which.

DETAILED DESCRIPTION

Figure 1:
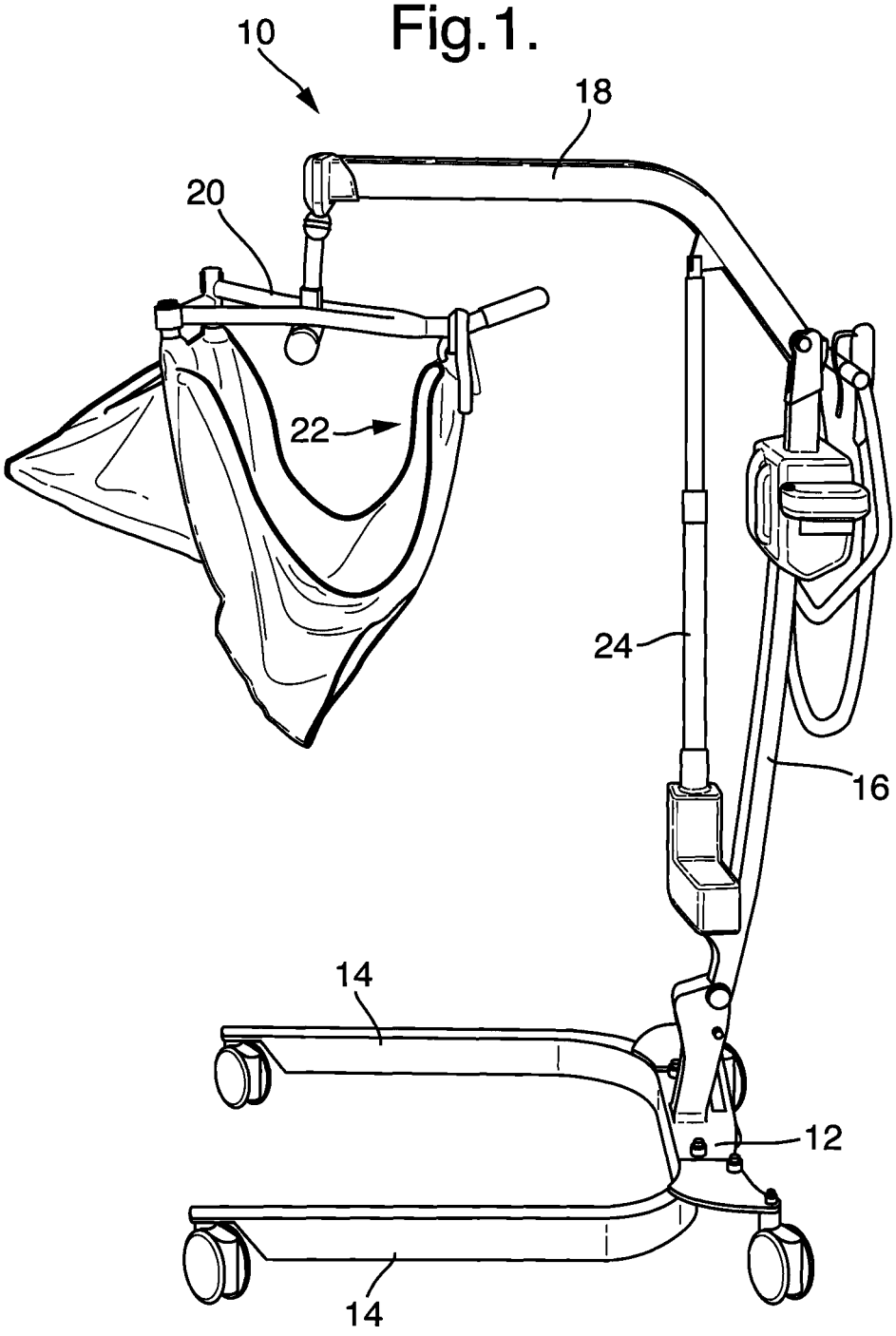
FIG. 1 is perspective view of an example of arc type patient lift.

Referring first to FIG. 1, there is shown an example of arc-type patient lift 10. The lift 10 includes a base 12 conventionally provided with two legs 14 and a mast 16 extending from the base 12. The mast couples to a boom 18, which in turn is coupled to a spreader bar 20 to which a sling 22 or other patient support is coupled. A piston drive arrangement 24 is provided for raising and lowering the boom 18 and thus the sling 22. The patient lift 10 allows for the boom to be swung by a care worker in order to move the sling 22 so as to prepare for or to move a patient.

Figure 2:
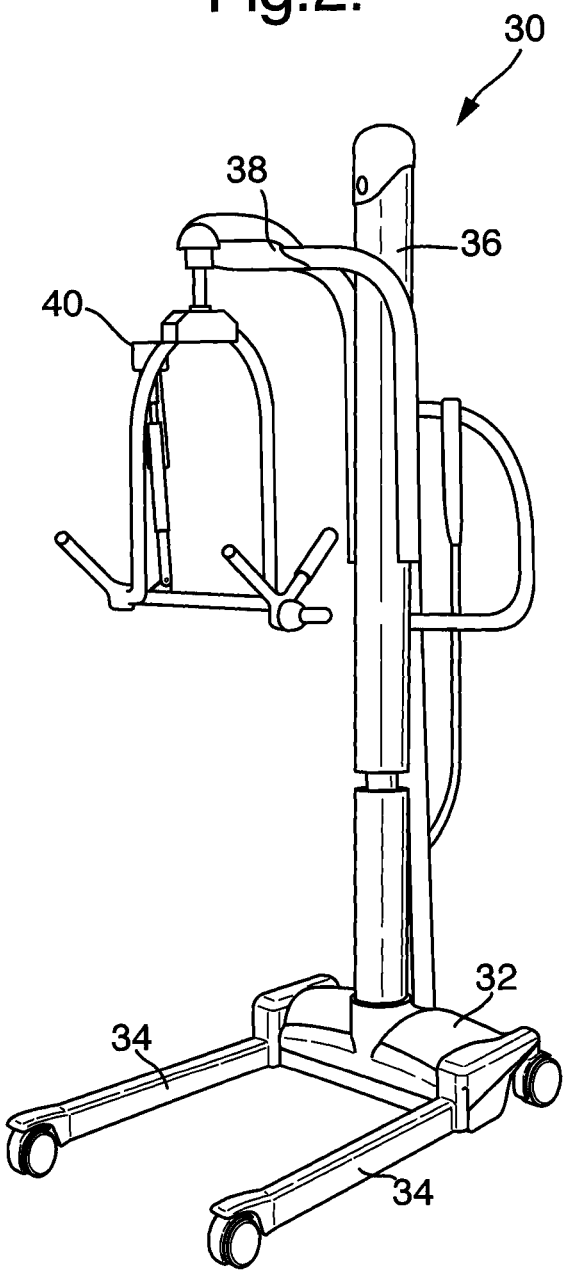
FIG. 2 is a perspective view of a column type patient lift.

FIG. 2 shows an example of a column-type patient lift 30, which is similarly provided with a base 32 having legs 34. The mast 36 extends vertically from the base 32 and in this example incorporates the piston lift arrangement for raising and lowering the mast. A boom 38 extends from the mast and at an end of this there is provided a spreader bar 40 which can support a sling or other coupling arrangement (not shown).

Figure 3:
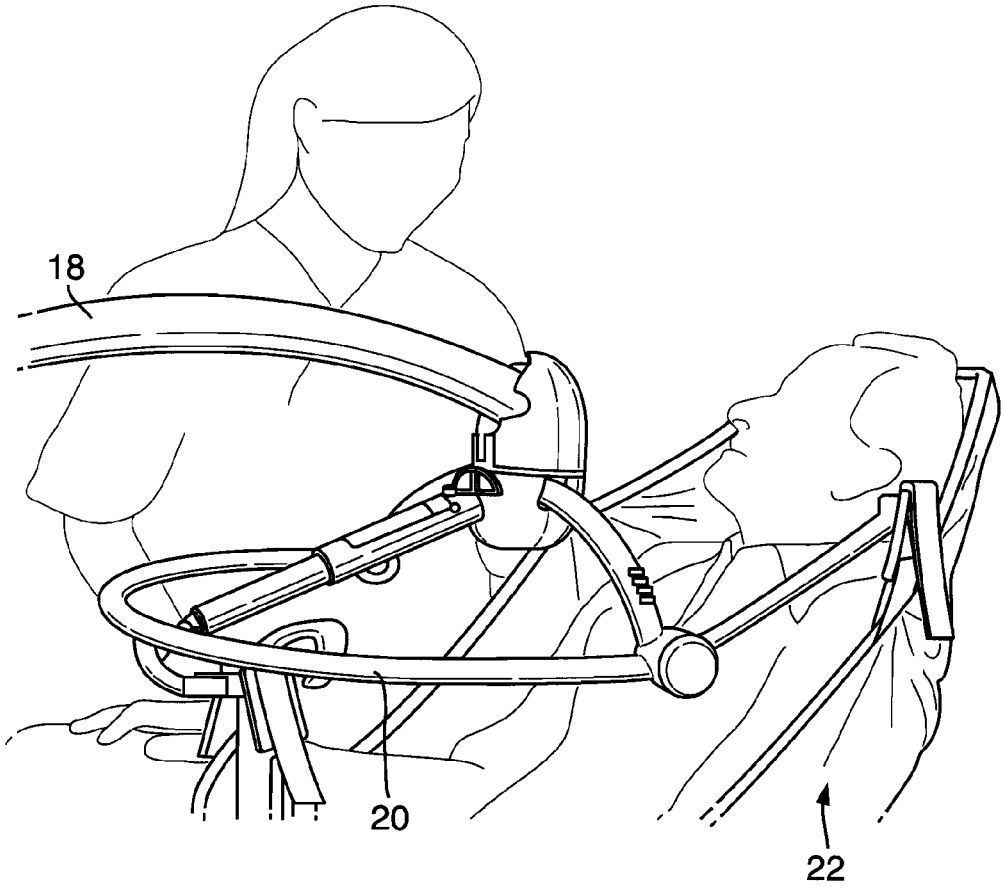
FIG. 3 is a view of the arc type patient lift of FIG. 1 being operated close to a patient.

Referring to FIG. 3, there can be seen the risk involved with conventional arc-type patient lifts. The spreader bar 20 is coupled to the boom 18 in an articulated manner, necessary for positioning the spreader bar and in particular any attachment such as the sling 22, so as to position a patient thereon or to move the patient once in the sling. As can be seen in FIG. 3, the rotatable coupling between the spreader bar 20 and the boom 18 can cause this to swing towards the patient as the patient lift is manipulated, presenting a potential risk of injury to the patient.

The preferred embodiments described herein provide various mechanisms and structures for substantially reducing or avoiding undesired swinging of the spreader bar or other device coupled to the boom during the manipulation of the patient lift. Even though the teachings herein are particularly suited to arc-type patient lifts, they could equally be used in column-type lifts.

Figure 4:
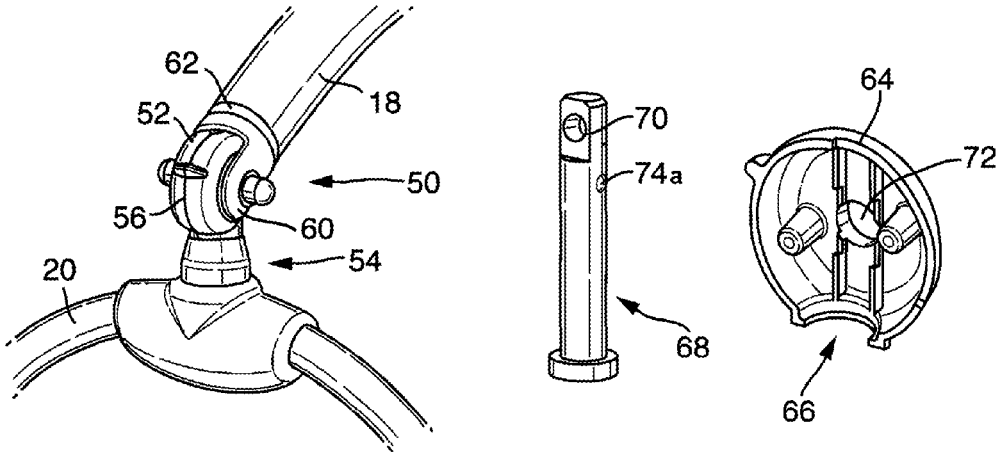
FIG. 4 is a perspective view of an embodiment of coupling for a patient lift.

Referring now to FIG. 4, there is shown a first embodiment of rotatable coupling 50 for location between a boom 18 and spreader bar 20 of a patient lift. The coupling provides a first component 52, shown in better detail in FIG. 5, which allows for rotational movement of the coupling and spreader bar 20 in a direction aligned with the boom 18. The coupling 50 also includes a second component 54 which allows for rotation of the spreader bar 20, typically in a vertical axis and in practice in an axis which is orthogonal to the axis of rotation of the coupling component 52. The rotational coupling component 54 can be a conventional rotary coupling and is therefore not described in detail herein.

Figure 5:
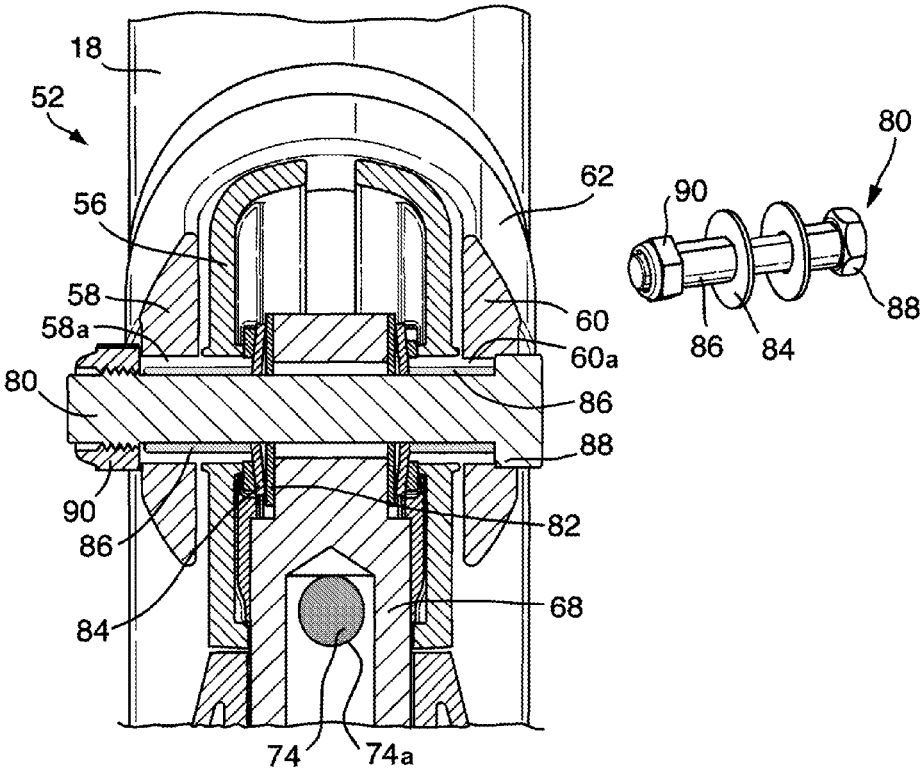
FIG. 5 is an exploded view in partial cross-section of the coupling of FIG. 4.

The coupling element 52 is shown in better detail in FIG. 5.

Referring now to FIG. 5, there is shown an exploded view, in partial cross-section, of the coupling arrangement 52 of FIG. 4. The components of this coupling unit 52 provide friction within the coupling, which is designed to be sufficient to prevent the coupling from swinging, and in particular the spreader bar 20, when there is no load on the lift. This prevents the swinging action shown in FIG. 3. The coupling component 52 includes a rounded housing 56 (seen better in FIG. 4) which fits between first and second arms or prongs 60 of a coupling 62 at the end of the boom 18. The boom coupling 62 is preferably fixed relative to the boom 18, that is it cannot rotate relative thereto, but this is not necessarily the case in all embodiments and could in some instances be rotatable.

The housing 56 is formed from two substantially identical housing halves 64, of which one is shown in FIG. 5. At a lower part of each housing half 64 there is provided a rounded aperture 66 for receiving a pin or rod 68 which forms part of the lower coupling unit 54. The pin or rod 68 includes a bore 70 therein which in practice is aligned with an aperture 72 in each of the housing halves 64 and with corresponding apertures 58*a*, 60*a* in the arms or prongs 58, 60. This can be seen clearly in the view in FIG. 5. The rod 68 has a bore 74*a* therein for receiving a pin 74 to which a rotatable disc or round coupling of the component 54 is attachable.

A bolt 80 fits into the coupling 52, passing through the apertures in the arms 58, 60, the apertures in the housing halves 64 and the aperture 70 in the rod 68, as shown in FIG. 5. Fitted onto the bolt 80 are first and second friction washers 82, which are disposed either side of the rod 68, by the aperture 70 thereof, and in particular against the flattened surfaces of that end of the rod 68. Also located on the bolt 80 are first and second disc springs 84, preferably in the form of Belleville springs. Coupling to the outside of each of these disc springs 84 are cylindrical sleeves 86, which extend along the bolt 80 such that one sleeve 86 abuts the enlarged head 88 of the bolt 80 and one disc spring 84 and the other abuts the other disc spring 84 and an the end of nut 90.

As the nut 90 is tightened onto the bolt 80 during assembly, this reduces the distance between the nut and the enlarged head 88, thereby compressing the cylinders 86 onto the disc springs 84, causing these in turn to press against the friction washers 82. This pressure creates a friction fit of the rod 68 to the boom 18 and thereby a friction fit of the boom 18 to the spreader bar 20 in a rotational direction around the axis of the rod 80. The amount of friction provided by this coupling is chosen so as to prevent the spreader bar 20 from swinging when this is not carrying a load or is only carrying a sling or other medical component.

However, the friction fit is chosen to allow rotation about the coupling 52, in particular the bolt 80, by a care worker for example, for positioning the sling or spreader arms 20 and preferably also when the lift is carrying a load, typically a patient. This assists in the movement of the patient once carried by the lift.

It will be apparent that the embodiment of FIGS. 4 and 5 does not affect the aesthetic design of the lift.

Figure 6:
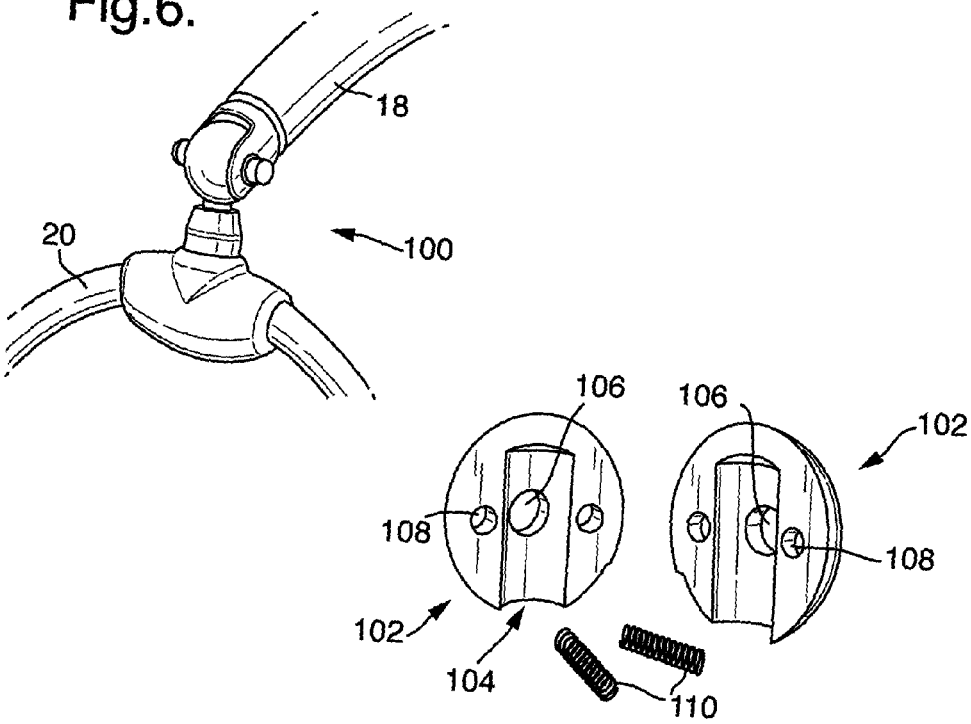
FIG. 6 is a perspective view of another embodiment of coupling for a patient lift.
Figure 7:
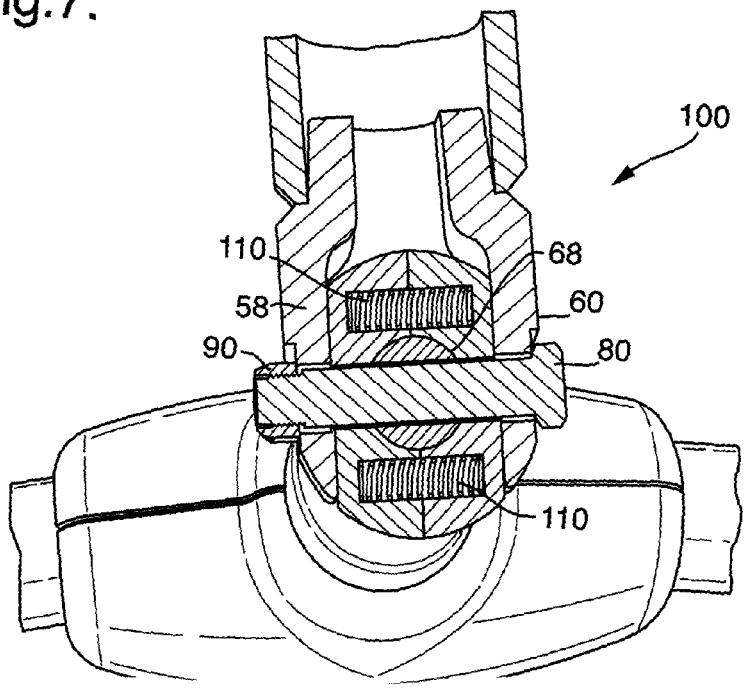
FIG. 7 is an exploded view in partial cross-section of the coupling of FIG. 6.

Referring now to FIGS. 6 and 7, there is shown another embodiment of coupling. This embodiment has a coupling component 100 which is externally aesthetically similar to the coupling component 50 of the embodiment of FIG. 4. The lower part of component 100, which allows rotation about a vertical axis, can be the same as the component 54 of the embodiments of FIGS. 4 and 5.

Referring to FIG. 7, the coupling includes a rotatable member formed of two halves 102 which are generally rounded in their exterior, circumferential, surfaces, each presenting a partial hemisphere configuration as illustrated, and which have a bore or slot 104 therein for receiving the end of pin 68, as with the embodiment of FIGS. 4 and 5. This is shown in particular in FIG. 7. The coupling halves 102 are also provided with circular apertures 106 therein, which align with the aperture 70 of the pin or rod 68 and, the apertures in the arms 58, 60 at the end of the boom 18.

The coupling halves 102 are also provided with blind bores 108 therein, this embodiment having two blind bores in each coupling half 102, into which there are located coil springs 110. A nut 80 passes through the apertures in the arms 58, 60, the coupling halves 102 and in the end of the rod 68, as shown in the drawing and this is fixed by a nut 90.

As will be apparent from FIG. 7, the springs 110, which are set in a compressed condition when fitted into the coupling 100 in the manner shown in FIG. 7, will press the two coupling parts 102 away from one another and into abutment with the inner surfaces of the arms 58, 60. For this purpose and to enable rotation of the coupling about the bolt 80, the outer surfaces of each coupling half 102 and the inner surfaces of each of the arms 58, 60 are substantially flat. In one embodiment, the coupling parts 102 are made of relatively high friction materials. In this manner, as the coil springs 110 press the coupling halves 102 against the inner walls of the arms 58, 60, friction is created within the coupling, which prevents unwanted swinging of the coupling and as result of the spreader arms 20. In another embodiment there may be provided friction discs between the coupling halves 102 and the arms 58, 60.

As with the embodiment of FIGS. 4 and 5, it is preferred that the friction produced by this coupling 100 is such to prevent unwanted swinging of the spreader arms 20 and any component attached thereto but still allows swinging when a patient is being lifted by the device or when the device is deliberately manipulated by a care worker.

Figure 8:
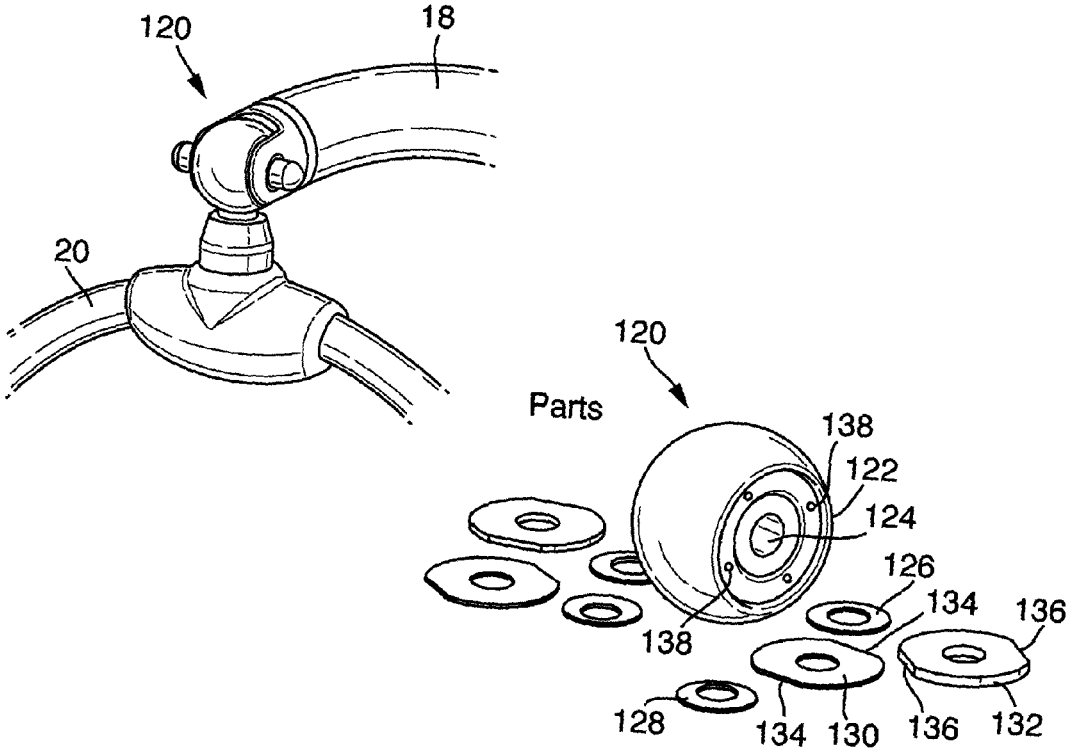
FIG. 8 is a perspective view of another embodiment of coupling for a patient lift.
Figure 9:
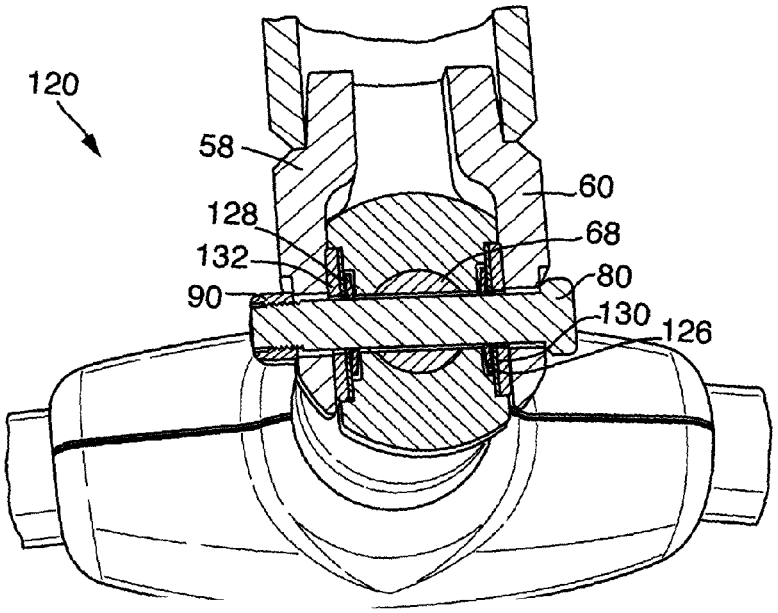
FIG. 9 is an exploded view in partial cross-section of the coupling of FIG. 8.

Referring now to FIGS. 8 and 9 there is shown another embodiment of coupling which has similarities to the embodiments of FIGS. 4 to 7. In this embodiment, the coupling 120 includes a generally hemispherical roller member 122 provided with a transverse aperture 124 for receiving a bolt 80 and what could be termed a longitudinal aperture for receiving the end of the bolt 68. The lateral sides of the roller 122, that is those by the transverse apertures 124, are in this embodiment stepped surfaces able to receive, in the following order a first metal washer 126, a first disc spring 128, a second metal washer 130 and a friction washer 132. The second metal washer 130 and the friction washer 132 have cut-out parallel side surfaces 134, 136 respectively, which align with corresponding shoulders within the stepped recess of the coupling roller 122. The disc springs 128 can be Belleville springs, which have the effect of pressing the various components 126-132 in such a manner as to press the friction washers 132 against the inner walls of the arms 58, 60. It will be appreciated that the friction washers 132 are prevented from rotating relative to the roller elements 122.

The friction washers 132 apply pressure against the inner surfaces of the arms 58, 60 and thereby create a friction fit for preventing undesired swinging of the coupling about the bolt 80 and thereby undesired swinging of the spreader arms 20.

The metal washers 126, 130 are not necessary but are provided in this embodiment to allow the roller element 122 to be made of a plastics material. This gives support to the disc springs 128 which are located between the two metal washers.

Figure 10:
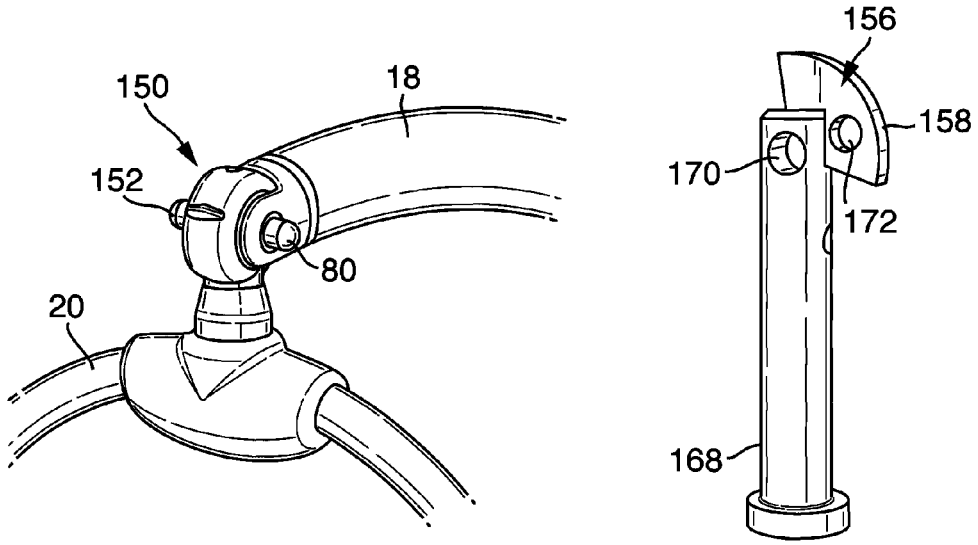
FIG. 10 is a perspective view of another embodiment of coupling for a patient lift.
Figure 11:
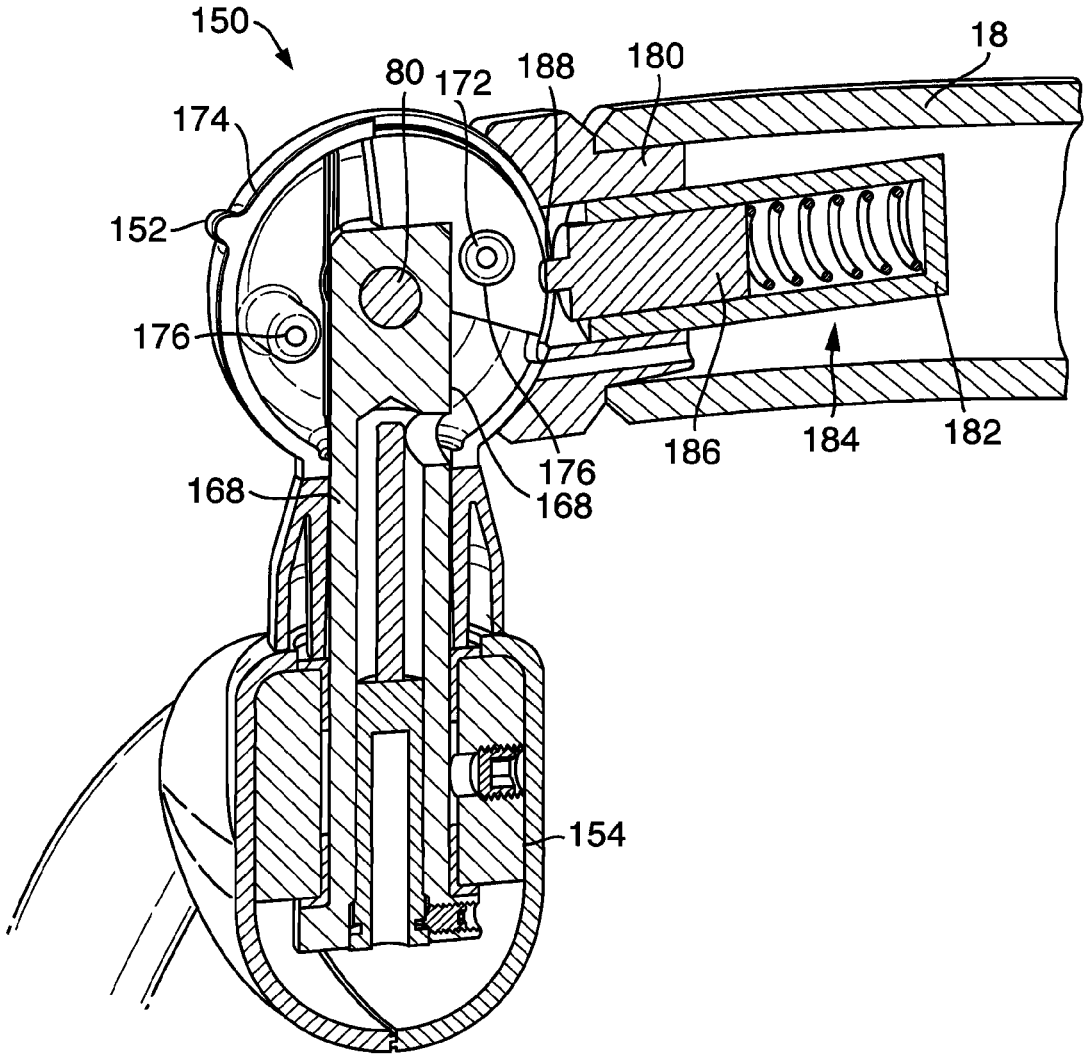
FIG. 11 is an exploded view in partial cross-section of the coupling of FIG. 10.

Referring now to FIGS. 10 and 11, there is shown another embodiment of coupling assembly for a patient lift, which includes a pivotable coupling 150 having external shape similar to that of the embodiments of FIGS. 4 to 9. In this embodiment, the coupling 150 is provided on its outer surface with a stop shoulder 152 for limiting the amount of pivoting of the coupling 150 about the bolt 80. A stop element of this nature could be included with the embodiments of FIGS. 6 to 8 if desired and in also shown in FIG. 4.

In the embodiment of FIGS. 10 and 11, the rod 168 which couples to the lower rotatable coupling portion 154 is provided at its upper end with a part-disc element 156 which is welded or otherwise securely attached to or formed with the rod 168, in the manner shown in FIG. 11. The part-disc 156 provides a circumferential friction surface 158, the function of which is described in further detail below. The rod 168 is also provided with an aperture 170 therein, as with the embodiments of FIGS. 4 to 9 and there is also provided an aperture 172 in the part-disc 156. Referring to the cross-sectional view of FIG. 11, the rod 168 fits within housing 174 (only half of which being visible in FIG. 11), such that the aperture 170 fits around the bolt 80 and the part-disc 156 fits with its aperture 172 around a fixing boss 176 of the housing portion 174. This provides secure engagement of the rod 168 in the housing 174 of the coupling 150. The coupling 150 is also provided with a sleeve 180 to which are attached a cylinder 182 within which there is provided a compression spring 184 and a friction piston 186. The friction piston includes a pin 188 which abuts against the circumferential surface 158 of the part-disc 156. The compression spring 184 presses the friction piston 186 against the surface 158. In the arrangement shown in FIG. 11, the spring 184 is always compressed in the cylinder 182 and thus will cause a constant pressure to be applied by the pin 188 against the surface 158, in order to create friction within the coupling 150 to stop undesired swinging of the spreader arms 20.

Figure 12:
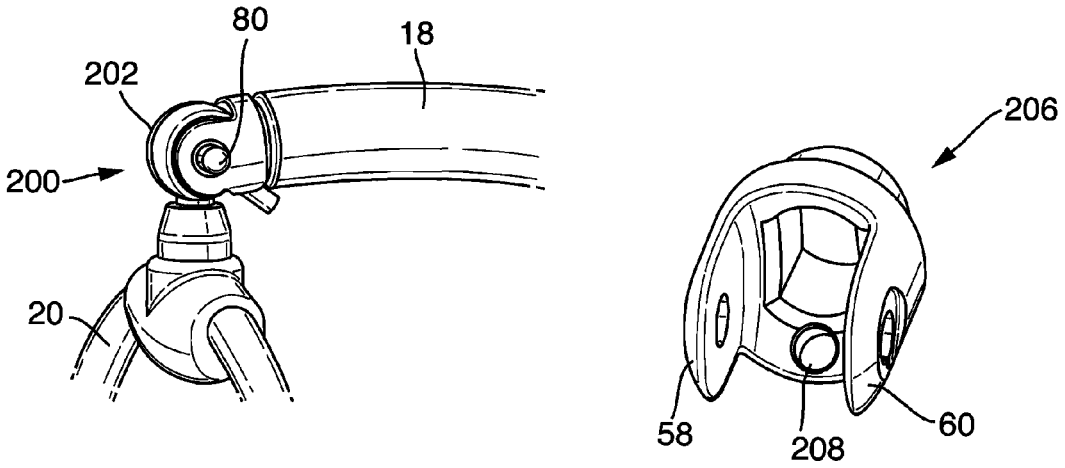
FIG. 12 is a perspective view of another embodiment of coupling for a patient lift.
Figure 13:
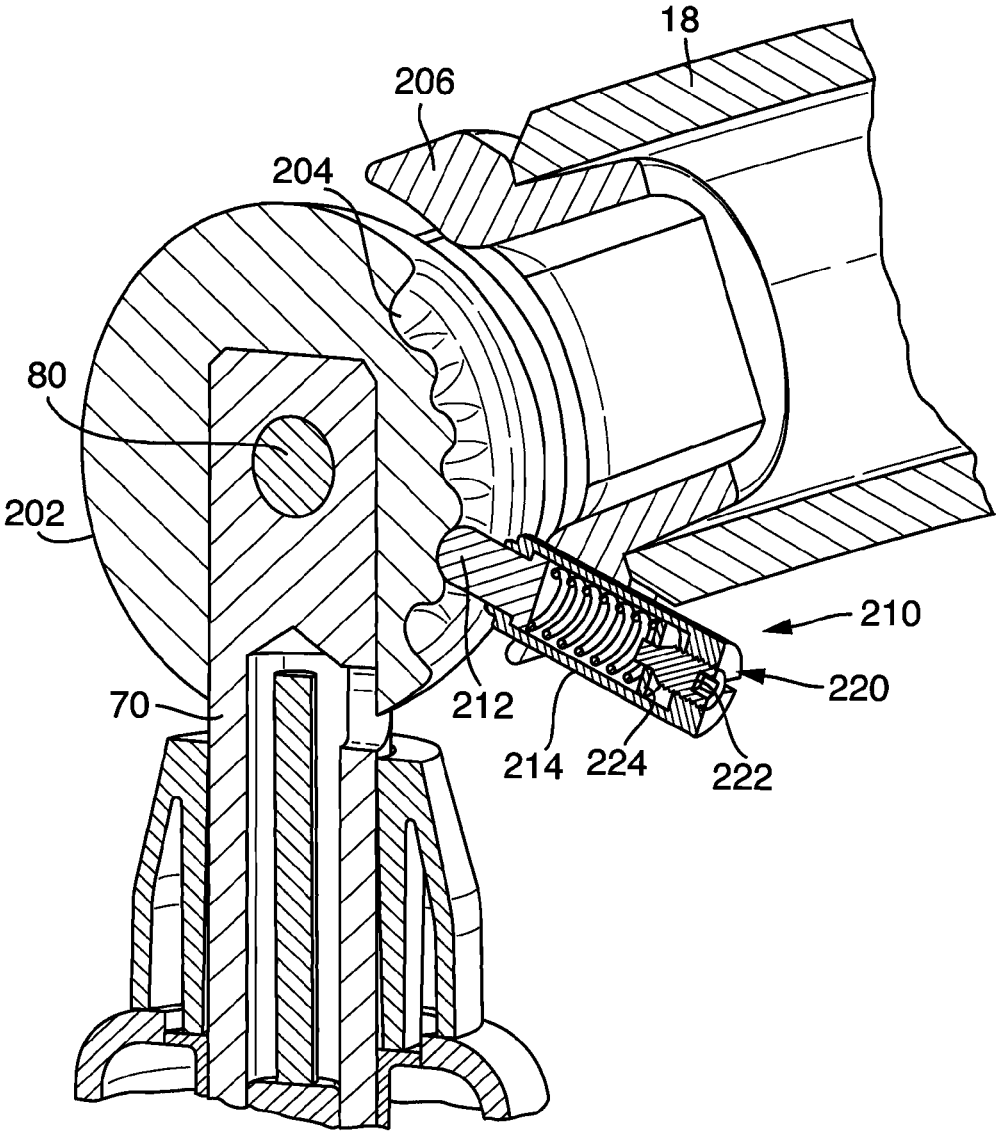
FIG. 13 is an exploded view in partial cross-section of the coupling of FIG. 13.

Referring now to FIGS. 12 and 13, there is shown another embodiment of coupling assembly having similarities to the embodiments of FIGS. 4 to 11. In this embodiment, the coupling 200 includes a rotary member 202 (which may or may not be formed in two parts) which rotates about the bolt 80. As can be seen in FIG. 13 in particular, in this embodiment, the rotary coupling element 202 is provided with a groove or recess 204 which is formed to have a series of shallow depressions within the groove. The jib end 206 of the boom 18 is provided with an aperture or slot 208 which receives a friction element 210. The friction element includes a friction pin 212 with a rounded end which fits within the shallows in the groove 204, as shown in FIG. 13. The friction element 210 also includes a compression spring 214 for pressing the friction pin 212 into the groove 204. The friction pin 212, together with the shallows in the groove 204, provides what could be described a step-wise movement or rotation of the coupling element 200 about the bolt 80 and prevents unwanted swinging of the coupling and in particular of the spreader arms 20.

The friction element 210 includes, in this embodiment an adjustment mechanism 220, which is in the form of a screw element 222 and disc 224. The adjustment element 220 is able to move the disc 224 backwards and forwards within the housing 210 in order to change the amount of pre-compression of the spring 214 and thereby the pressure of the friction pin 212 into the groove 204. This gives an adjustable amount of friction to the coupling.

It will be appreciated that it is not necessary to have a groove 204 or to have the series of depressions or shallows within the groove 204 and that in some embodiments this could be a smooth surface against which the friction pin 212 abuts. In this embodiment, unwanted swinging would be prevented by the friction forces of the pin 212 against the element 202.

It is to be appreciated that in all embodiments there could be provided a mechanism for adjusting the amount of friction produced in the coupling, either a mechanism as shown in FIGS. 12 and 13 or another mechanism, including for instance an adjustable nut 90.

Figure 14:
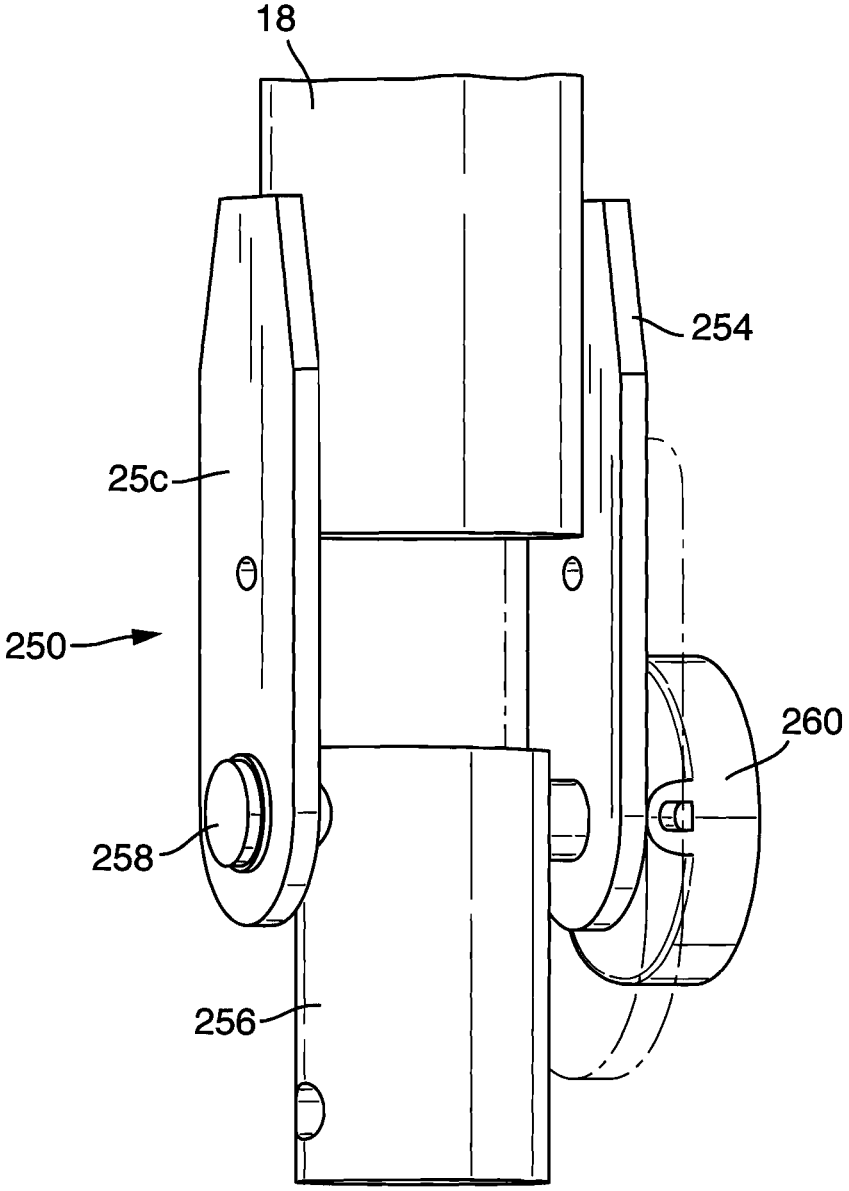
FIG. 14 shows an embodiment of coupling element for a patient lift incorporating a damper.

Referring now to FIG. 14, there is shown another embodiment of coupling element for a patient lift. The coupling arrangement 250 couples to the boom 18 of a patient lift and is provided with first and second arms 252, 254 fixed to the boom 18. The arms 252, 254 are connected to a coupling member 256 (which couples to the spreader arms 20 via a suitable mechanism). The connection to the coupling 256 is by means of a bolt or rod 258 which fits across the coupling 256 and is attached thereto so as to rotate with the coupling 256. A viscous-type rotary damper 260 is fixed onto the arms 254 and acts to dampen rotation of the arm 254 relative to the coupling element 256 the damper 260, which may be of known form, acts to provide a restraining force against rapid movement of the coupling element 256 relative to the boom 18 and therefor of the spreader bar 20 relative to the boom 18. On the other hand, the damper 260 provides much less and preferably virtually no resistance to rotation of the coupling element 256 at lower rates of rotation. Thus, the coupling element 250 prevents or substantially reduces instances of swinging of the coupling element 256 upon movement of the boom 18.

Figure 15:
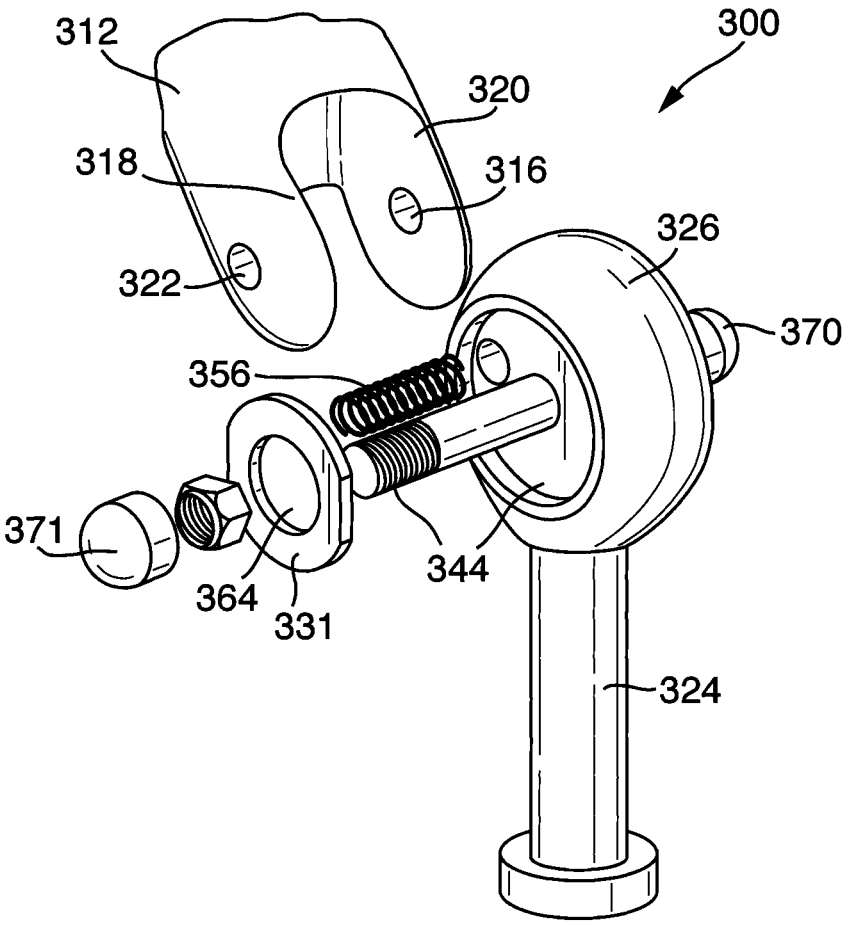
FIG. 15 is an exploded view of another embodiment of friction coupling.

Referring now to FIG. 15, there is illustrated a portion of another embodiment of patient lift and friction coupling 300. The lift includes a boom 312 provided with first and second prongs 316 and 318. Although the prongs 316 and 318 shown protrude in a generally parallel arrangement, other arrangements may be suitable. A first generally circular bore 320 having a first generally longitudinal axis is formed through the first prong 316. Similarly, a second generally circular bore 322 having a second generally longitudinal axis is formed through the second prong 318. Preferably, the first and second axes are substantially coaligned. It should be appreciated that the bores 320 and 322 may have a shape other than the generally cylindrical shape described.

The lift also includes a spreader bar 324 provided with a second support member 326 protruding therefrom. A third bore (not shown) having a third generally longitudinal axis is formed through the second support member 326. The first, second, and third bores 320, 322, and 328 have substantially the same diameter, such that when the bores 320, 322, and 328 are aligned they create a generally uniform cylindrical passageway.

Two friction washers 364 (only one of which is shown in FIG. 15) are each disposed against respective inner faces of the prongs 316, 318 of boom 312. The bores 331 are aligned with bores 320, 322, and 328 to create a generally uniform cylindrical passageway. Two compression springs 356 (only one of which is shown in FIG. 15) are disposed abutting the friction washers 364 with the spreader bar support member 326 in between. The compression springs 356 urge the friction washers 364 against the inner faces of the prongs 316, 318.

Two pins 344 prevent rotation of the friction washers 364 and a bolt 370 locks the lift assembly together. The bores 320, 322, 328 and 331 have a crosswire inner dimension that permit the pin bolt 370 to pass therethrough. The bolt 370 has nuts or heads 371, or like members, to lock the assembly.

In this embodiment it is preferred mat the spreader bar 324 does not swing at all when the lift is moved without load. The friction coupling 300 reduces the swing of the patient, when transferred in the lift. This makes the lift easier to manoeuvre for the caregiver. The coupling fits into existing hoists and does not affect the design of the lift.

It will be appreciated that the various embodiments of coupling element described above can be fitted to existing patient lift arrangements. They are therefore suitable for retrofitting.

Those of skill in the art will appreciate that embodiments not expressly illustrated herein may be practiced within the scope of the claims, including that features described herein for different embodiments may be combined with each other and/or with currently-known or future-developed technologies while remaining within the scope of the claims. Drawings are not necessarily to scale, including that proportions within a drawing may be exaggerated and/or some textually described elements may be omitted to more clearly illustrate certain components and/or functions. Although specific terms are employed herein, they are used in a generic and descriptive sense only and not for purposes of limitation. It is therefore intended that the foregoing detailed description be regarded as illustrative rather than limiting. And, it should be understood that the following claims, including all equivalents, are intended to define the spirit and scope of this invention. Furthermore, the advantages described above are not necessarily the only advantages of the invention, and it is not necessarily expected that all of the described advantages will be achieved with every embodiment.

The invention claimed is:

1. A patient lift, comprising:

a boom, the boom including at least two generally aligned boom end prongs, a spreader bar, and a friction coupling; wherein the friction coupling is received between the boom end prongs and releasably attaches a portion of the spreader bar to the boom end prongs by means of a bolt generally transverse to longitudinal axes of the boom end prongs and disposed through a transverse aperture of the spreader bar, said bolt and transverse aperture configured to allow pivoting, around a longitudinal axis of the bolt, of the spreader bar relative to the boom;

wherein the friction coupling is configured to reduce swinging of the spreader bar relative to the boom when the spreader bar is unladen;

wherein the friction coupling includes at least one friction member disposed between the boom and the spreader bar; and wherein the at least one friction member is urged against one of the boom and the spreader bar by at least one spring directing a biasing contact with the other of the boom and the spreader bar.

2. The patient lift of claim 1, wherein the at least one spring is embodied as a disc spring disposed around the bolt.

3. The patient lift of claim 2, further comprising a biasing element adjacent the bolt and disposed between the disc spring and an end of the bolt.

4. The patient lift of claim 2, further comprising a cylindrical sleeve slidably encircling a portion of the bolt between the disc spring and an end of the bolt that further comprises a bolt-end element selected from a bolt head and an adjustable nut, where the cylindrical sleeve is configured to transmit biasing force between the bolt-end element and the disc spring.

5. The patient lift of claim 1, wherein the at least one spring is embodied as a pair of disc springs disposed around the bolt, with the bolt passing through a bore of the spreader bar and contacting the boom end prongs on either side of the spreader bar, wherein one disc spring is disposed between the spreader bar and a prong on either side of the spreader bar.

6. The patient lift of claim 5, wherein the at least one friction member comprises at least one friction washer disposed between one of the disc springs and the spreader bar.

7. The patient lift of claim 1, wherein the spreader bar includes a rod that is disposed intermediate the boom end prongs;

wherein the at least one friction member includes a first friction washer disposed encircling the bolt and contacting a first side of the rod and a second friction washer disposed encircling the bolt and contacting a second side of the rod;

wherein the at least one spring includes a first Belleville disc spring disposed around the bolt and contacting the first friction washer, and a second Belleville disc spring disposed around the bolt and contacting the second friction washer;

the bolt further comprising bolt ends each disposed outside the boom end prongs and thereby opposite boom end prong surfaces facing the rod, where said bolt ends comprise a bolt head defining a larger outer diameter at one bolt end and a nut defining a larger outer diameter at an opposite bolt end, said bolt disposed through apertures of the boom end prongs aligned with the transverse aperture of the rod; and the bolt further comprising a biasing sleeve encircling a portion of the bolt between the nut and the first friction washer and another biasing sleeve encircling a portion of the bolt between the second friction washer and the bolt head, said biasing sleeves configured to transmit biasing force centrally along the bolt when the bolt and nut are engaged and rotated so as to advance the nut and bolt head closer together.

* * * * *